US008517290B2

(12) United States Patent
Thiel

(10) Patent No.: US 8,517,290 B2
(45) Date of Patent: Aug. 27, 2013

(54) INSTALLATION AND PROCESS FOR THE MILLING-DRYING AND STORAGE OF BROWN COAL

(75) Inventor: Jens-Peter Thiel, Horneburg (DE)

(73) Assignee: Claudius Peters Projects GmbH, Buxtehude (DE)

( * ) Notice: Subject to any disclaimer, the term of this patent is extended or adjusted under 35 U.S.C. 154(b) by 22 days.

(21) Appl. No.: 13/349,382

(22) Filed: Jan. 12, 2012

(65) Prior Publication Data

US 2012/0292413 A1 Nov. 22, 2012

Related U.S. Application Data

(60) Provisional application No. 61/488,458, filed on May 20, 2011.

(30) Foreign Application Priority Data

May 20, 2011 (EP) ..... 11166867

(51) Int. Cl.

| | |
|---|---|
| ***B02C 17/00*** | (2006.01) |
| ***B02C 21/00*** | (2006.01) |
| ***B02C 23/00*** | (2006.01) |

(52) U.S. Cl.
USPC ..... 241/19; 241/23; 241/24.24; 241/24.31

(58) Field of Classification Search
USPC ..... 241/18, 19, 23, 24.24, 24.31
See application file for complete search history.

(56) References Cited

U.S. PATENT DOCUMENTS

| | | | | |
|---|---|---|---|---|
| 4,193,554 | A * | 3/1980 | Ansen et al. | 241/19 |
| 5,353,997 | A | 10/1994 | Kasseck et al. | |
| 2010/0043675 | A1 | 2/2010 | Lohle et al. | |

FOREIGN PATENT DOCUMENTS

| | | |
|---|---|---|
| EP | 0 154 281 | 9/1985 |
| EP | 0 579 214 | 1/1994 |
| WO | WO-2007/022837 | 3/2007 |

* cited by examiner

*Primary Examiner* — Faye Francis
(74) *Attorney, Agent, or Firm* — Morrison & Foerster LLP

(57) ABSTRACT

A process and installation for the milling-drying and storage of brown coal. Brown coal is milled to form brown coal dust in a low-oxygen atmosphere at temperatures which are higher compared to the prior art. Then, the brown coal dust is washed with low-oxygen, dry second conveying gas and stored in a silo in a low-oxygen, dry atmosphere at a temperature of above 60° C. The installation is designed to carry out this process and comprises, for the process steps mentioned above, a mill, a dust washing installation and a silo.

15 Claims, 7 Drawing Sheets

INSTALLATION AND PROCESS FOR THE MILLING-DRYING AND STORAGE OF BROWN COAL

REFERENCE TO RELATED APPLICATIONS

This application claims the priority of European Patent Application No. 11166867, filed May 20, 2011, and of U.S. Provisional Application No. 61/488,458, filed May 20, 2011, the entire contents of which are incorporated herein by reference.

FIELD OF THE INVENTION

The invention relates to a process and to an installation for the milling-drying and storage of brown coal.

BACKGROUND OF THE INVENTION

The intention of the milling-drying of raw brown coal is for the brown coal to be milled to a small particle size. At the same time, the intention is for moisture to be removed from the raw brown coal, such that brown coal dust with a low level of moisture is available after milling-drying has been effected. To this end, it is known in the prior art to dry the brown coal in a dryer (e.g. a tubular dryer) and to thereby remove the moisture from the brown coal. Then, the dried brown coal is milled to form brown coal dust and stored. In order to allay the risk of explosion during the milling operation and the risk of spontaneous ignition during storage, maximum temperatures which lie below the explosion or spontaneous ignition temperature are provided for the milling and the storage. In DE 42 23 151, 70 to 85° C. is indicated as the temperature range for milling, and a maximum temperature of 60° C. is indicated for storage. These temperatures can only be achieved by active cooling.

Furthermore, it is known to mill and dry brown coal in a single process step. To this end, the brown coal is dried during the milling operation, e.g. by injecting hot gas into the milling chamber of the mill. In order to avoid dust explosions in the mill, the drying gas must not exceed a certain temperature upon entry into the mill, however. VDI 2263 stipulates that the appropriate gas inlet temperature must not lie above ⅔ of the ignition temperature of the substance to be milled. For milling brown coal, this means a maximum gas inlet temperature of the drying gas of about 270° C. When it leaves the mill, the brown coal dust produced by a corresponding process is at a temperature of about 90° C., and has to be actively cooled to below 60° C. for safe storage.

In processes in which brown coal is milled and dried and then directly burned in a boiler, it is furthermore known to use flue gas for drying in the mill. In this case, the flue gas is at a temperature above the ignition temperature of brown coal, for example 1000° C. At the same time, however, this flue gas has a low oxygen content of about 6 to 12% by volume, and therefore dust explosions within the mill can be prevented. Since the brown coal dust is then directly burned, there is virtually no risk of a dust explosion and/or of spontaneous ignition of the brown coal dust.

SUMMARY OF THE INVENTION

It is an object of the present invention to provide a process and an installation for the milling-drying and storage of brown coal which are improved with respect to the prior art mentioned in the introduction.

This object is achieved by a process and installation as broadly disclosed herein. Advantageous developments become apparent from the detailed disclosure.

Accordingly, the invention relates to a process for the milling-drying and storage of brown coal, comprising the following steps:

a) brown coal is milled and dried to form brown coal dust in a mill with a low-oxygen drying gas and at a gas inlet temperature above the ignition temperature of brown coal;
b) the milled and dried brown coal dust is conveyed out of the mill with the aid of a first conveying gas;
c) the conveyed brown coal dust is flushed with a dry second conveying gas containing even less oxygen than the first conveying gas to exchange the first conveying gas with the second conveying gas;
d) the brown coal dust is conveyed further with the aid of the second conveying gas; and
e) the brown coal dust which has been conveyed further is stored in a silo at a temperature of above 60° C. and in a low-oxygen, dry atmosphere.

Furthermore, the invention relates to an installation for the milling-drying of brown coal, comprising a mill for comminuting brown coal to form brown coal dust and a silo for storing brown coal dust, wherein the mill has a gas feed opening for drying gas and a material outlet for milled and dried brown coal dust, wherein provision is made of a dust washing installation, which is connected to the material outlet of the mill and the silo and is intended for flushing the brown coal dust with a dry, low-oxygen second conveying gas.

Within the context of the present invention, "low-oxygen" means that the oxygen content of a gas or of an atmosphere lies below the oxygen content of air, preferably around 10%, if appropriate also thereunder. In the case of a gas containing even less oxygen than a low-oxygen gas, the oxygen content is preferably around 3% or thereunder. Within the context of the present invention, a gas or an atmosphere is "dry" if the water content in each case lies below 3% by volume.

Within the context of the present invention, "flushing" firstly encompasses the exchange of a first gas with a second gas. Secondly, it can also be provided, however, that the first gas is mixed with a further gas or is diluted thereby, such that the second gas is created.

In conjunction with the present invention, "brown coal" encompasses as a generic term both hard brown coal and soft brown coal.

With the process according to the invention, it is possible to reduce the water content in the case of brown coal from for example originally 30% by volume to 8% by volume, and at the same time to achieve comminution to particles having a grain size of less than 500 μm. The invention has identified that temperatures which lie above the maximum temperatures indicated in the prior art can be used for the brown coal milling-drying with subsequent storage without explosions or instances of spontaneous ignition, if at the same time the oxygen and/or water content in the atmosphere surrounding the brown coal or the brown coal dust is reduced to a sufficient extent such that an explosion or spontaneous ignition reaction is not activated. This applies in particular during the milling and during the storage of brown coal dust.

A dust explosion occurs if finely distributed, solid dust particles of a combustible substance are ignited or heated to a temperature above the ignition temperature in the oxygen-rich atmosphere, e.g. air. The large surface common to the dust particles causes a sudden explosive ignition of all the dust.

If brown coal dust which has been dried to below its equilibrium moisture content is stored at an elevated temperature and with freely available atmospheric humidity, the atmospheric humidity is condensed, leading to a rise in the temperature of the brown coal dust. As the temperature increases, oxygen present in the space between the dust particles or interstitial volume then triggers further exothermic reactions. As the temperature continues to increase, the oxygen bound in the coal becomes the free partner for exothermic reactions throughout the brown coal dust volume, and the brown coal dust ignites spontaneously.

According to the invention, it is provided that the brown coal is milled and dried in a mill. In this case, the drying gas required for the drying has a gas inlet temperature (the temperature of the drying gas as it enters into the mill) above the ignition temperature of brown coal. At the same time, the drying gas is a low-oxygen gas, and therefore dust explosions in the mill are effectively avoided despite the aforementioned gas inlet temperature. The oxygen content of the drying gas is preferably less than/equal to 12% by volume, further preferably less than/equal to 8% by volume, further preferably less than/equal to 6% by volume. It can also be provided that the oxygen content of the drying gas is between 8 and 12% by volume. The water content of the drying gas is preferably less than/equal to 35% by volume. It is further preferred if the water content of the drying gas is set in such a way that a water content of less than/equal to 35% by volume is set in the atmosphere within the mill.

In the case of an appropriate drying gas, gas inlet temperatures above the ignition temperature of brown coal are possible. In this respect, the gas inlet temperature of the drying gas is preferably less than or equal to 850° C., further preferably less than or equal to 625° C., further preferably less than or equal to 550° C. It can also be provided that the gas inlet temperature of the drying gas is 625° C., further preferably 500° C. With the latter temperatures, it is possible to achieve a good drying action. At the same time, it is possible—as investigations have shown—to use the steel 1.4878 for the various components of the mill. By taking the limits of use of this steel into account, the mill can be produced at relatively low cost. If higher gas inlet temperatures are required or desirable, it may be necessary for individual components of the mill to be produced from more expensive materials.

The mill is preferably formed in such a way that the milled brown coal or the brown coal dust has a mean product fineness of 40 to 100 μm. The mill is preferably in the form of a ring-ball mill. It is possible to use all types of air-swept mills, in particular all types of roll mills, however.

A coal dust having an ignition temperature which can be determined in accordance with DIN EN 50281-2-1 is therefore formed in the mill. For a mixture of coal dust and air having a product fineness of 45% residue on 90 μm, the ignition temperature given an oxygen content of 21% by volume can thus be 400° C., for example, in accordance with DIN EN 50281-2-1, and 540° C. given an oxygen content of 12% by volume. In a departure from the stated standard, given an otherwise identical test procedure it is also possible to determine when first ignition sparks arise in the mixture of coal dust and air. Given an oxygen content of 12% by volume, this can be the case starting from 460° C., for example, given 10% by volume starting from 500° C., given 8% by volume starting from 520° C. and given an oxygen content of 6% by volume starting from 650° C.

For the coal described by way of example, but also for other comparable coals, the process according to the invention can reliably be carried out, for example, with a gas inlet temperature of 500° C. and an oxygen content of the drying gas of less than/equal to 6% by volume, without an ignitable mixture of coal and gas being formed. In this case, the parameters can be chosen in such a way that sufficient security is afforded against spontaneous ignition and explosions. Parameters which are suitable for safely carrying out the process according to the invention in this case also depend, inter alia, on the material to be milled, i.e. the type of coal, and the degree of milling.

After the milling-drying has been effected, the brown coal dust is conveyed out of the mill with the aid of a first conveying gas. At this point in time, the brown coal dust is at a temperature of considerably more than 60° C. In particular, the temperature thereof may be 70 to 110° C., preferably 80 to 100° C., preferably 90° C. The first conveying gas can preferably be drying gas. In this case, when leaving the mill the drying gas which has been introduced into the mill can carry along sufficiently finely milled brown coal particles and thus convey the latter out of the mill. If a gas other than the drying gas is used as the first conveying gas, the temperature and oxygen content of this gas have to be chosen in such a way as to avoid the risk of a dust explosion. The first conveying gas or drying gas generally has a high water content, since the water which is released in the mill and originates from the brown coal is carried along in the first conveying gas or drying gas.

The milled brown coal dust which is conveyed out of the mill with the first conveying gas is then flushed with a dry second conveying gas containing even less oxygen than the first conveying gas. In the process, the first conveying gas is preferably virtually completely exchanged with the second conveying gas. The second conveying gas preferably has an oxygen content of less than/equal to 3% by volume and a water content of preferably less than/equal to 5% by volume, further preferably less than 3% by volume. The brown coal dust can be flushed using, for example, a gas conveyor channel, in which the brown coal dust is guided over a gas-permeable floor. The second conveying gas then escapes from the gas-permeable floor and displaces the first conveying gas from the spaces among the brown coal dust. If the first conveying gas is drying gas, both the oxygen content and the water content in the mixture of brown coal dust and gas are reduced considerably by the above-described flushing operation, since the second conveying gas is low-oxygen, dry gas with an oxygen and water content which is fundamentally lower than that of the drying gas. This also applies analogously when the first conveying gas is not the drying gas. The second conveying gas thus preferably has a lower oxygen and water content than the first conveying gas.

As an alternative to this, it is possible for a further gas to be admixed to the mixture of first conveying gas and brown coal dust, such that the second conveying gas is formed by the first conveying gas being mixed with the further gas. The first conveying gas thus becomes the second conveying gas as a result of being mixed with or diluted by the further gas.

With the aid of the second conveying gas, the brown coal dust is then conveyed further and ultimately stored in a silo. The temperature of the brown coal dust upon storage is above 60° C., usually around 90° C. In order to avoid spontaneous ignition of the brown coal dust in the silo, a low-oxygen and dry atmosphere prevails in the silo. Since the brown coal dust is introduced into the silo with the aid of the likewise dry and low-oxygen second conveying gas, an appropriate atmosphere can also be retained during feeding of brown coal dust. The oxygen content in the atmosphere in the silo is preferably less than/equal to 3% by volume. The water content of the atmosphere in the silo is preferably less than/equal to 3% by volume. In an appropriate atmosphere, it is possible for the temperature of the brown coal dust upon storage in the silo to be 70 to 110° C., preferably 80 to 100° C., preferably 90° C., without there being the risk of spontaneous ignition.

Furthermore, it can be provided that the silo can be flushed with dry and low-oxygen gas. Appropriate flushing can be effected as required, for example in the case of appropriate monitoring of the atmosphere in the silo, or regularly. Appropriate flushing can ensure that the atmosphere in the silo is constantly dry and low-oxygen, such that spontaneous ignition of the brown coal dust in the silo can be effectively prevented.

Furthermore, it is preferable if an excess pressure with respect to the atmosphere prevails in the silo and/or the mill. As a result, the incursion of external air (the undesired influx of ambient air possibly with a high oxygen and/or water content) is effectively avoided.

An inert gas, for example nitrogen, is used with preference as the second conveying gas and/or gas for flushing the silo. In order to achieve the required or desired oxygen and/or water contents for the individual gases mentioned, the inert gas can be set to the desired composition, if appropriate, with humidifiers and dehumidifiers, and also by mixing with air. For the drying gas and/or the first conveying gas, it is also possible to use combustion exhaust gases or the like having a low oxygen content instead of an inert gas. By mixing with air and/or by using humidifiers and dehumidifiers, it is also possible to set any desired oxygen and water contents in the case of combustion exhaust gases.

The invention relates furthermore to an installation for the milling-drying and storage of brown coal, which is designed to carry out the process according to the invention. The installation according to the invention comprises a mill for comminuting brown coal to form brown coal dust and a silo for storing brown coal dust, wherein the mill has a gas feed opening for drying gas and a material outlet for milled and dried brown coal dust, and wherein provision is made of a dust washing installation, which is connected to the material outlet of the mill and the silo and is intended for flushing the brown coal dust with dry, low-oxygen second conveying gas.

It is furthermore preferable if the silo has a gas inlet opening for dry and low-oxygen gas and for provision to be made of a control device, which controls the gas feed into the mill and/or the silo in such a way that the operating parameters of the process according to the invention are observed.

It is preferable if the dust washing installation for flushing the brown coal dust is in the form of a gas-operated conveyor channel, in which the brown coal dust flows over a gas-permeable floor together with a first conveying gas. The second conveying gas flows through the air-permeable floor and displaces the first conveying gas from the spaces among the brown coal dust.

It is furthermore preferable if the silo and/or the mill are designed so as to prevent the incursion of fresh air. To this end, it can be provided that the mill and/or the silo are sealed to a particular extent. In particular, individual components of the mill and/or of the silo can be welded to one another in a pressure-tight manner for this purpose.

In conjunction with the present invention, the term "silo" is to be interpreted broadly. Thus, the term "silo" encompasses not only stationary stores but also, for example, railroad tank cars or appropriate trucks.

The brown coal dust stored in the silo can be removed as desired and can be used, for example, in coal gasification or for briquette production, but also for firing blast furnaces or in power plants.

It is possible to provide the mill with cooling elements, which are activated in the event of an interruption in operation in order to cool down brown coal dust which accumulates in the mill to such an extent that there is no spontaneous ignition or smoldering fire. During correct operation, however, the cooling elements are not activated, and therefore do not effect any cooling action. Furthermore, it is possible to provide the mill with apparatuses, e.g. scrapers, with which deposits of brown coal dust can be removed during operation. Furthermore, the mill can be provided with an extinguishing device, with which smoldering fires which may occur can be extinguished.

BRIEF DESCRIPTION OF THE DRAWINGS

The invention will now be described in more detail on the basis of an advantageous embodiment with reference to the appended drawings.

DETAILED DESCRIPTION OF THE INVENTION

Figure 1:
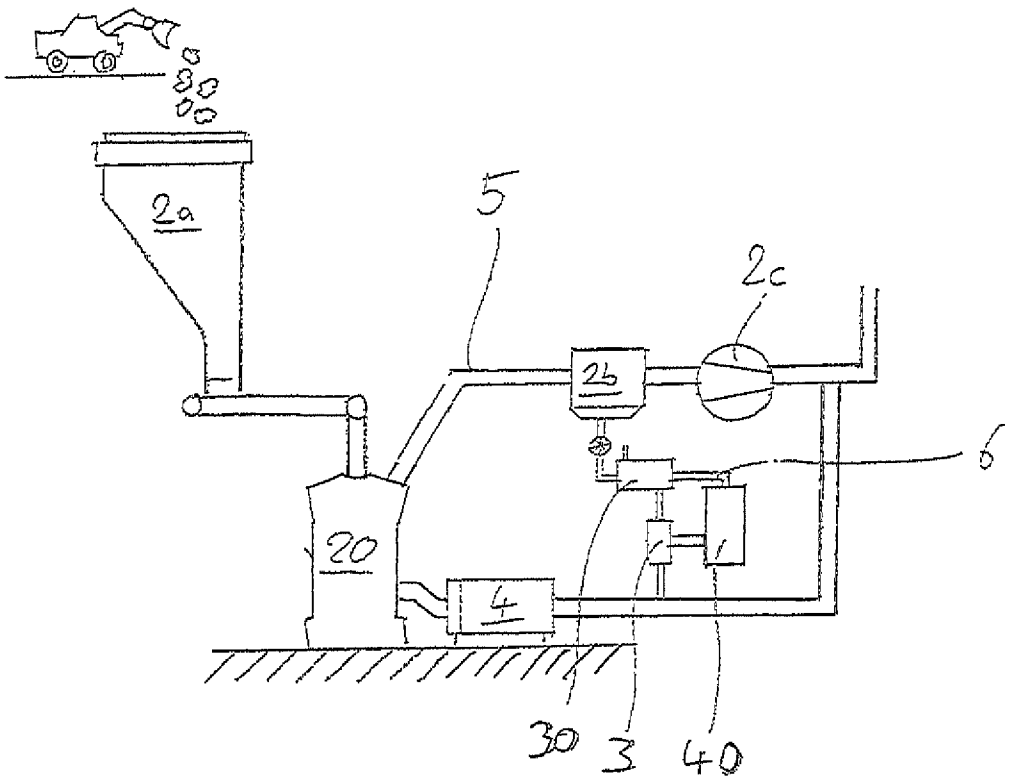
FIG. 1 shows an installation according to the invention for the milling-drying and storage of brown coal.
Figure 5:
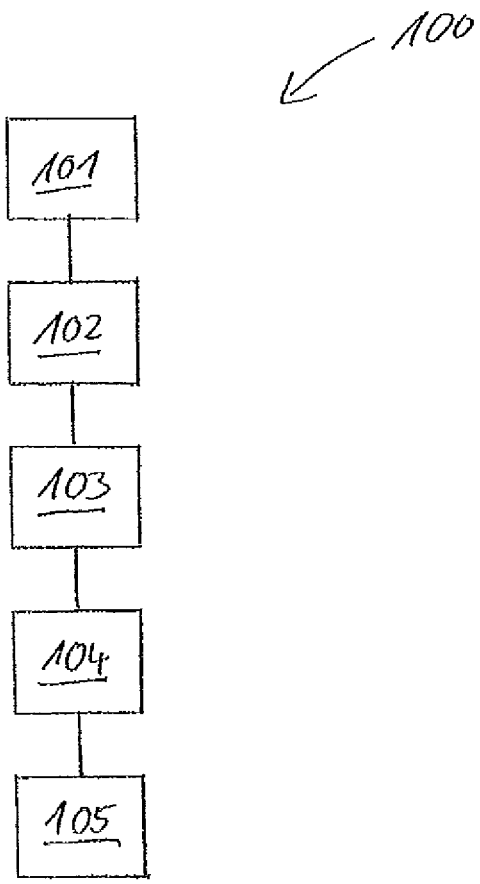
FIG. 5 is a schematic illustration showing the process according to the invention which is carried out with the installation shown in FIG. 1.

FIG. 1 shows an installation 1 according to the invention for the milling-drying and storage of brown coal. FIG. 5 schematically shows the process 100 which is carried out with said installation 1.

The installation 1 comprises a mill 20, a dust washing installation 30 and a silo 40. The structure of the mill 20, of the dust washing installation 30 and of the silo 40 is shown in more detail in FIGS. 2 to 4. Furthermore, the installation 1 is also provided with a charging apparatus 2*a*, a filter 2*b*, a fan 2*c*, a gas source 3 and a heating element 4. The heating element 4 can be in particular a hot-gas generator.

The brown coal which is to be milled and dried and stored passes via the charging apparatus 2 in metered form into the mill 20. The charging apparatus 2 is operated in such a way here that the filling level in the mill 20 always lies in a predefined tolerance range.

The first process step 101, the milling and drying of the brown coal to form brown coal dust, is carried out in the mill 20.

Figure 2:
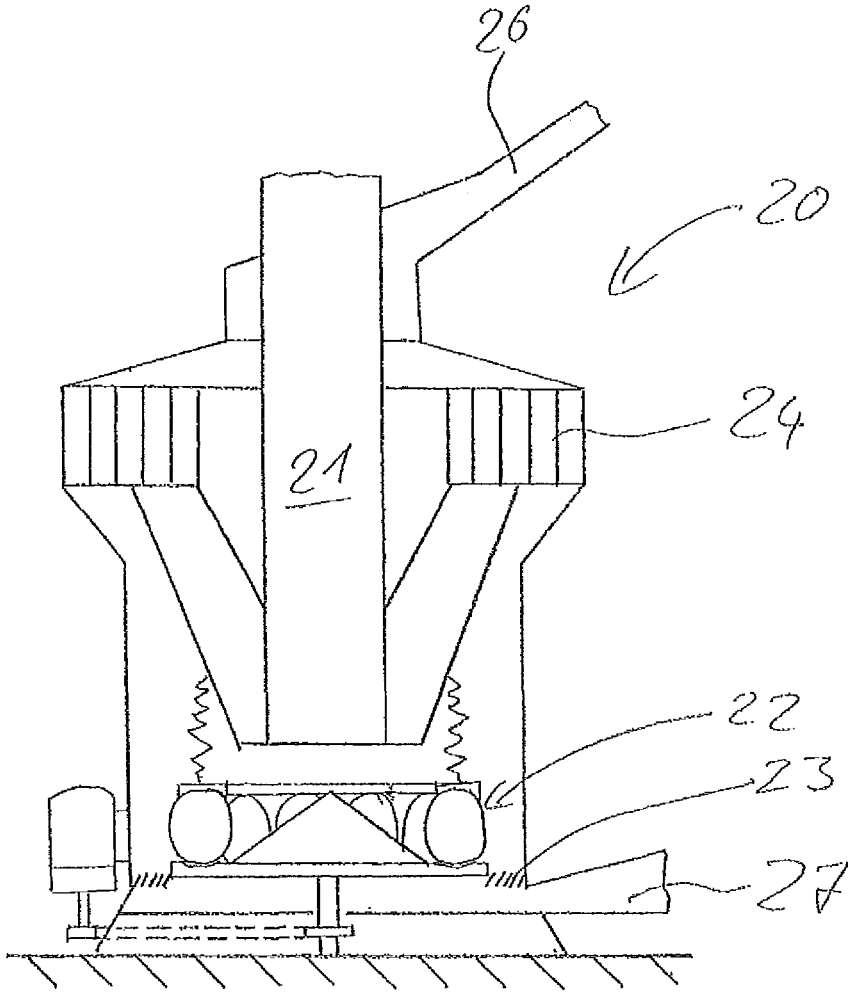
FIG. 2 is a detailed view showing the mill of the installation shown in FIG. 1.

As shown in FIG. 2, the mill 20 is a ring-ball mill, in which the brown coal is fed through a material inlet 21 to a milling unit 22. The brown coal is milled in a known manner in the milling unit 22 and then emerges laterally from the milling unit 22. A nozzle ring 23, through which firstly the conveying gas flows, is provided arranged annularly around the milling unit 22 on the floor. The milled brown coal is carried away by the first conveying gas and transported to a sifter 24 in the upper region of the mill 20. The sifter 24 separates out particles which have not yet reached the desired fineness of, in this case, less than 500 μm, and feeds them back to the milling unit 22. Sufficiently fine particles, having a particle size of less than 500 μm, form the desired brown coal dust, and are conveyed with the first conveying gas through the material outlet 26.

In the case of the mill 20 in FIG. 2, the first conveying gas is simultaneously the drying gas according to the invention. The drying gas enters into the mill 20 via the connection 27 at a temperature above the ignition temperature of the brown coal to be milled. This gas inlet temperature is 625° C. In addition, the drying gas also has an oxygen content of less than/equal to 12% by volume and a water content of less than/equal to 35% by volume.

The volumetric flow rate of the drying gas is determined by the fan 2*c*. The composition of the drying gas is given by the hot gases from the heating element 4, the water vapor evaporated from the coal and leakage air flows which possibly arise and also if appropriate an inert gas which is made available by the gas source 3.

As a result of feeding the aforementioned drying gas into the mill 20, a sufficiently high temperature which brings about drying of the brown coal is achieved within the mill 20. Although corresponding temperatures would lead to dust explosions under normal atmospheric conditions, dust explosions are effectively avoided by the low oxygen content in the drying gas and therefore also within the mill 20.

The milled and dried brown coal passes into the material outlet 26 together with the drying gas (or first conveying gas) if the desired particle size has been reached, i.e. the brown coal is present in the form of brown coal dust. At this point, the brown coal dust is at a temperature of about 90° C. Since the brown coal dust is furthermore surrounded by the low-oxygen drying gas, there is no risk of dust explosions.

In the next process step 102, the brown coal dust is conveyed, with the aid of the drying gas (or first conveying gas), from the material outlet 26 of the mill 20 via a connection line 5 into a filter 2*b*, where it is separated. The separated brown coal dust is conveyed further to a dust washing installation 30, where it is flushed (step 103). Various embodiments of dust washing installations 30 are shown in more detail in FIGS. 3*a-c*. Depending on the requirement, the dust washing installation 30 can be realized via one of the systems shown in FIGS. 3*a-c*.

Figure 3A:
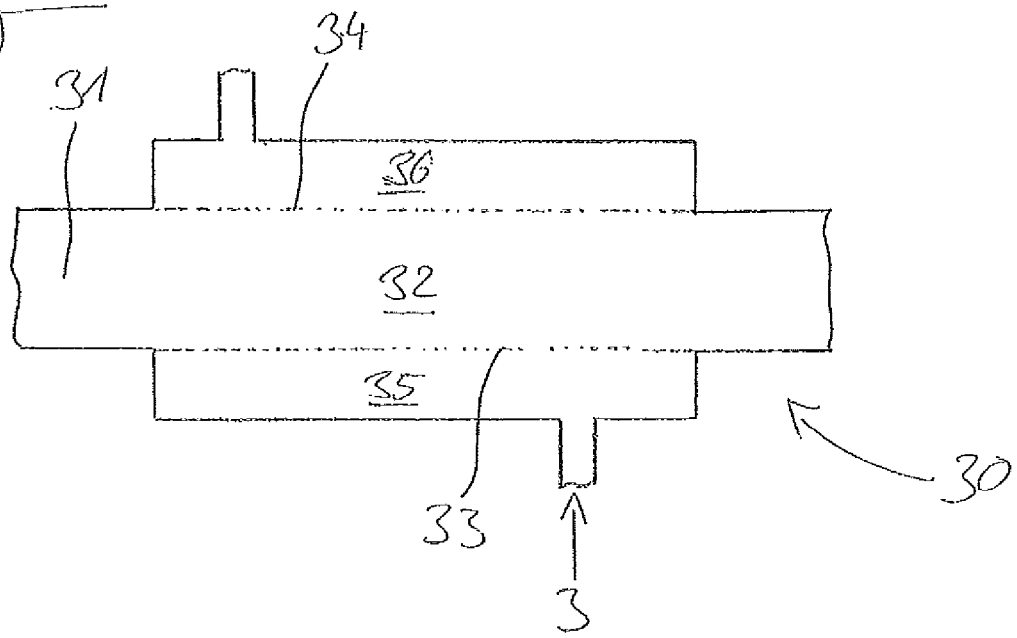
FIGS. 3*a-c* are detailed illustrations showing a possible dust washing installation for the installation shown in FIG. 1.
Figure 4:
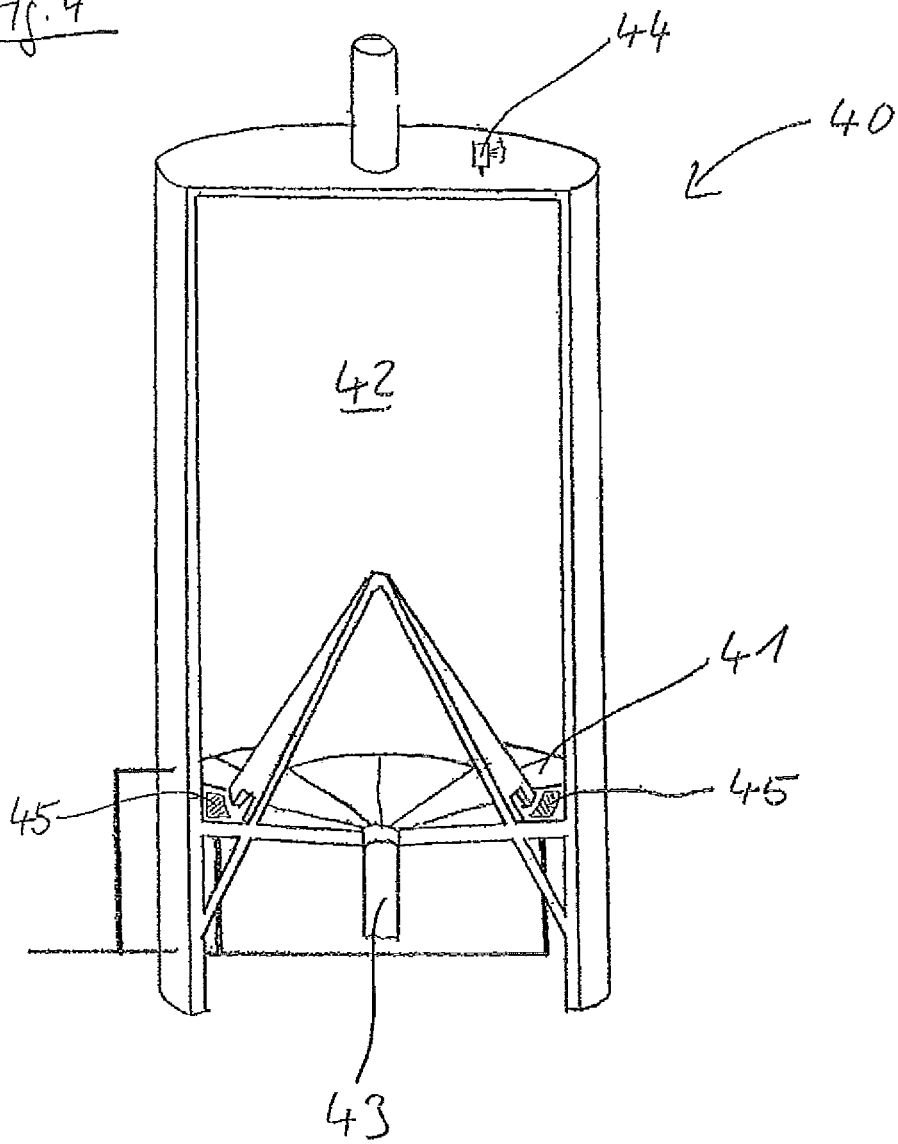
FIG. 4 is a detailed illustration showing the silo of the installation shown in FIG. 1.

In the dust washing installation shown in FIG. 3*a*, the mixture of drying gas and brown coal dust passes via the inlet 31 into the dust washing installation 30, which is in the form of a ventilation box. The dust washing installation 30 is distinguished by the fact that the flow duct 32 for the brown coal dust has a gas-permeable floor 33 and a gas-permeable upper boundary 34. As seen from the flow duct 32, a respective gas distributor space 35, 36 is located downstream of the gas-permeable floor 33 and downstream of the gas-permeable upper boundary 34. The lower gas distributor space 35 is connected in this case to the gas source 3 (cf. FIG. 1), whereas the upper gas distributor space 36 is connected to the surroundings. A second conveying gas is introduced into the lower gas distributor space 35 from the gas source 3 and flows through the gas-permeable floor 33 into the flow duct 32. Since the second conveying gas flows into the flow duct 32 in which the mixture of brown coal dust and drying gases (or first conveying gas) is located, the brown coal dust is washed. Specifically, the second conveying gas displaces the drying gas (or first conveying gas) from the spaces among the brown coal dust. The drying gas (or first conveying gas) passes via the gas-permeable upper boundary 34 into the gas distributor space 36 and from there into the surroundings. As a result, a mixture of brown coal dust and second conveying gas is present at the outlet of the dust washing installation 30.

Figure 3B:
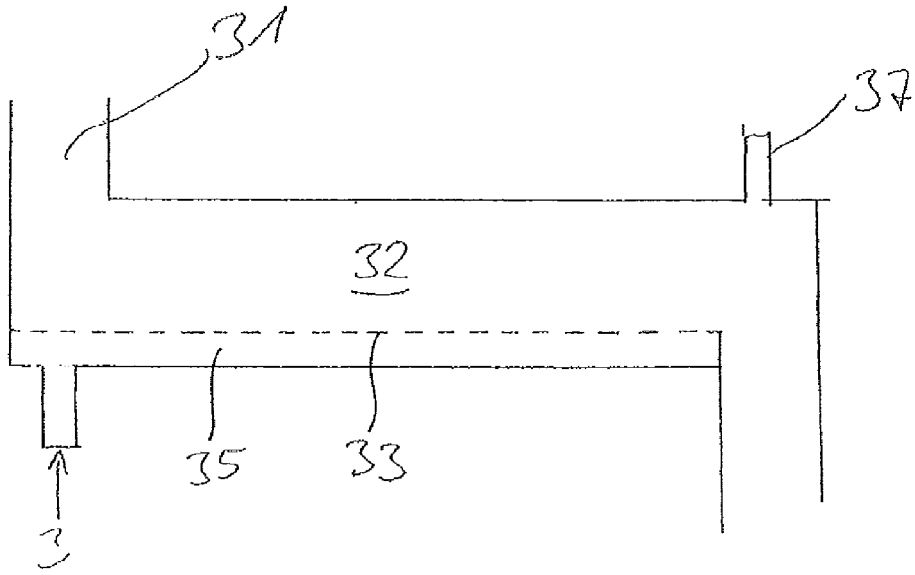

The dust washing installation 30 shown in FIG. 3*b* is in the form of a gas conveyor channel and functions in principle in the same way as the dust washing installation 30 shown in FIG. 3*a*. The mixture of drying gas and brown coal dust passes via the inlet 31 into the dust washing installation 30. The dust washing installation 30 comprises a flow duct 32 for the brown coal dust which has a gas-permeable floor 33. Underneath the gas-permeable floor 33, there is a gas distributor space 35, which is connected to the gas source 3 (cf. FIG. 1). A second conveying gas is introduced into the lower gas distributor space 35 from the gas source 3 and flows through the gas-permeable floor 33 into the flow duct 32. Since the second conveying gas flows into the flow duct 32 in which the mixture of brown coal dust and drying gases (or first conveying gas) is located, the brown coal dust is washed. Specifically, the second conveying gas displaces the drying gas (or first conveying gas) from the spaces among the brown coal dust. The drying gas (or first conveying gas) passes via the gas outlet 37 into the surroundings. As a result, a mixture of brown coal dust and second conveying gas is present at the outlet of the dust washing installation 30.

Figure 3C:
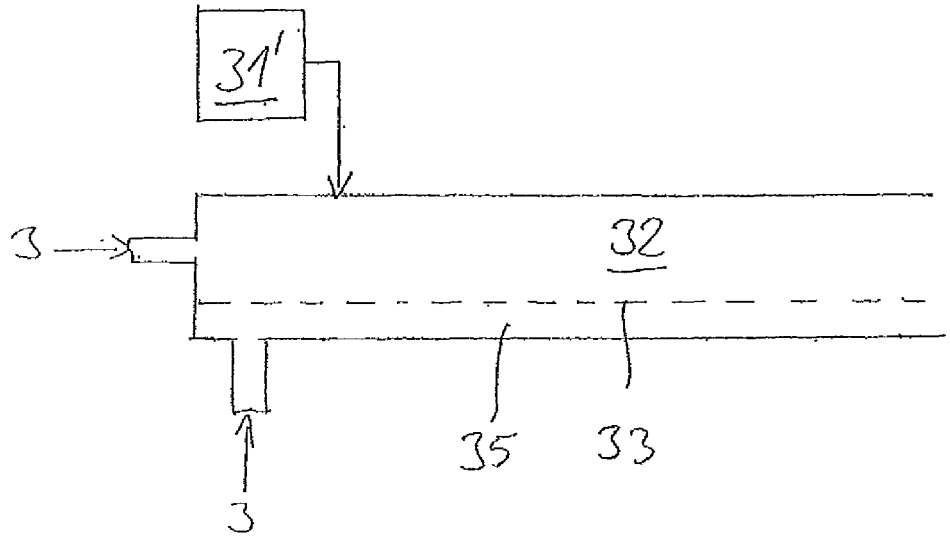

The dust washing installation 30 shown in FIG. 3*c* is in the form of a pneumatic conveyor line. The mixture of drying gas and brown coal dust passes via a charging element 31' into the dust washing installation 30. The dust washing installation 30 comprises a flow duct 32 for the brown coal dust which has a gas-permeable floor 33. Underneath the gas-permeable floor 33, there is a gas distributor space 35, which is connected to the gas source 3 (cf. FIG. 1). A gas is introduced into the lower gas distributor space 35 from the gas source 3 and flows through the gas-permeable floor 33 into the flow duct 32. In addition, the gas is also introduced at one end of the flow duct 32, as a result of which a momentum is exerted on the mixture of brown coal dust and gas, such that the brown coal dust is conveyed to the other end of the flow duct 32. The gas introduced into the flow duct 32 dilutes the drying gas (or first conveying gas) in such a manner that the second conveying gas is formed. The mixture of brown coal dust and second conveying gas then emerges at the end of the pneumatic conveyor line.

The second conveying gas has a lower oxygen and/or water content than the drying gas (or first conveying gas). This is true particularly since the water which has been released from the brown coal during the drying operation is carried along with the drying gas and increases the water content of the latter. The second conveying gas is distinguished by the fact that the oxygen content is less than/equal to 3% by volume and the water content is less than 3% by volume. An appropriate gas is made available by the gas source 3.

Proceeding from the dust washing installation, the mixture of second conveying gas and brown coal dust is conveyed further via the connection line 6 to the silo 40 (step 104). The temperature of the brown coal dust has substantially not been changed by the conveying and the flushing, and therefore the brown coal dust is at a temperature of about 90° C. upon entry into the silo 40. The brown coal dust is therefore stored in the silo 40 at a temperature of 90° C. (step 105).

The brown coal dust passes together with the second conveying gas into the silo 40, where it is stored. Since second conveying gas continuously flows into the silo 40 together with the brown coal dust, an atmosphere having an oxygen content of less than/equal to 3% by volume and a water content of less than/equal to 3% by volume is set in the silo 40. In the case of an appropriate atmosphere, it is possible to store brown coal dust at a temperature of up to 90° C., in which case no spontaneous ignition in particular occurs.

On account of the force of gravity, the brown coal dust is deposited on the floor 41 of the internal space 42 of the silo, and can be removed through an opening 43 in the floor 41 of the silo. Since second conveying gas also continuously flows into the silo together with the brown coal dust, provision is also made of a venting valve 44, with which gas can be let off into the surroundings. The venting valve 44 here is equipped with dust filters so as to be permeable only for gas.

In order to make it possible to regulate the atmosphere in the internal space 42 of the silo, gas inlet openings 45 are provided on the floor 41 and/or in the side wall of the silo 40 and can be used to feed gas originating from the gas source 3 into the internal space 42 of the silo. By means of a control unit (not shown), it is possible to monitor the atmosphere in the internal space 42 of the silo and, if appropriate, to regulate it by feeding in gas with a predefined composition, such that the atmosphere in the internal space 42 of the silo has an oxygen content of less than/equal to 3% by volume and a water content of less than/equal to 3% by volume. It is therefore possible to permanently prevent spontaneous ignition of the brown coal dust in the internal space 42 of the silo.

An excess pressure with respect to the environment prevails in the internal space 42 of the silo. This can avoid a situation where ambient air having a higher oxygen and/or water content can penetrate through possible leakage points in the silo 40 and possibly cause undesired reactions.

For a different type of coal, the installation shown in FIGS. 1 to 5 may have to be operated with other operating parameters in order to ensure safe operation. Thus, the gas inlet temperature can be 500° C., for example, and the oxygen content in the first drying gas can be less than/equal to 6% by volume.

The invention claimed is:

1. A process for the milling-drying and storage of brown coal, comprising:

milling and drying brown coal to form brown coal dust in a mill with a low-oxygen drying gas and at a gas inlet temperature above the ignition temperature of brown coal;

conveying the milled and dried brown coal dust out of the mill with the aid of a first conveying gas;

flushing the conveyed brown coal dust with a dry, low-oxygen second conveying gas to exchange the first conveying gas with the second conveying gas;

further conveying the brown coal dust with the aid of the second conveying gas; and storing the brown coal dust which has been conveyed further in a silo at a temperature of above 60° C. and in a low-oxygen, dry atmosphere.

2. The process as claimed in claim 1, wherein the drying gas has an oxygen content of less than/equal to 12% by volume, and a water content of less than/equal to 35% by volume.

3. The process as claimed in claim 1 or claim 2, wherein the second conveying gas has an oxygen content of less than/equal to 3% by volume or a water content of less than/equal to 3% by volume.

4. The process as claimed in claim 1, wherein the oxygen content in the silo is less than/equal to 3% by volume or the water content is less than/equal to 3% by volume.

5. The process as claimed in claim 1, wherein the gas inlet temperature of the drying gas is 625° C. or 500° C.

6. The process as claimed in claim 1, wherein the temperature of the brown coal dust upon storage in the silo is 70 to 110° C.

7. The process as claimed in claim 1, wherein the brown coal dust has a mean product fineness of 40 to 100 μm.

8. The process as claimed in claim 1, wherein the first conveying gas is drying gas.

9. The process as claimed in claim 1, wherein, if there is an increase in the oxygen or water content in the silo, the silo is flushed with dry, low-oxygen gas.

10. The process as claimed in claim 1, wherein the second conveying gas is substantially an inert gas.

11. The process as claimed in claim 1, wherein an excess pressure with respect to the environment is set in the silo.

12. The process as claimed in claim 1, wherein the drying gas has an oxygen content of less than/equal to 6% by volume, and a water content of less than/equal to 35% by volume.

13. The process as claimed in claim 1, wherein the temperature of the brown coal dust upon storage in the silo is 80 to 100° C.

14. The process as claimed in claim 1, wherein the temperature of the brown coal dust upon storage in the silo is 90° C.

15. The process as claimed in claim 1, wherein the second conveying gas is nitrogen.

* * * * *